United States Patent [19]

Hetznecker

[11] 4,148,022

[45] Apr. 3, 1979

[54] CHEMICAL SMOKE OR POLLUTANT DETECTOR

[75] Inventor: Frank W. Hetznecker, Buffalo Grove, Ill.

[73] Assignee: Honeywell Inc., Minneapolis, Minn.

[21] Appl. No.: 792,092

[22] Filed: Apr. 28, 1977

[51] Int. Cl.[2] ..... G08B 17/10

[52] U.S. Cl. ..... 340/628; 340/632; 422/98

[58] Field of Search ..... 340/237 S, 237 R, 628, 340/629, 630, 632, 633, 634; 23/232 E, 254 E, 255 E

[56] References Cited

U.S. PATENT DOCUMENTS

| | | | |
|---|---|---|---|
| 1,489,247 | 4/1924 | Hill | 23/232 E UX |
| 3,493,484 | 2/1970 | Berg et al. | 23/254 E UX |
| 3,594,751 | 7/1971 | Ogden et al. | 340/249 |
| 3,812,362 | 5/1974 | Larsen et al. | 340/237 S X |

*Primary Examiner*—John W. Caldwell, Sr.

*Assistant Examiner*—Daniel Myer

*Attorney, Agent, or Firm*—Trevor B. Joike

[57] ABSTRACT

A smoke or pollutant sensor has first and second conductors in non-electrical contact and a coating, between the first and second conductors, which chemically reacts with by-products of combustion to allow electrical conduction between the first and second conductors. A heating and cooling mechanism may be provided to condense the smoke onto the sensor during the cooling cycle and to aid the chemical reaction and the evaporation of any condensed water during the heating cycle. Third and fourth conductors may be provided without the coating material, and the first, second, third and fourth conductors may be connected to a detector for detecting changes in conductivity in the presence of smoke to provide an alarm function, the third and fourth conductors acting as a reference sensor to compensate for changes in humidity and atmospheric pressure.

23 Claims, 3 Drawing Figures

CHEMICAL SMOKE OR POLLUTANT DETECTOR

BACKGROUND OF THE INVENTION

This invention relates to a sensor for the detection of smoke and, particularly, a sensor which is treated with a chemical coating for reacting with byproducts of combustion to allow conduct between the conductors of the sensor.

In the area of fire detection, one of the first popular fire detection systems relied upon heat sensors for providing an alarm of an occurring fire. Because the sensors were only responsive to high heat conditions, an alarm would be given only after the fire had entered its final stage, i.e. flame. In large warehouses or office buildings, this type of system at least had the advantage of preventing destruction of other parts of the building even though that part of the building in which the fire occurred was most likely destroyed. For residential application, however, to wait until a fire has entered the flame stage usually means substantial if not total destruction of the residence. Moreover, since the early stages of fire produce gases or byproducts of combustion, e.g. quite frequently carbon monoxide and hydrogen cyanide, the fumes from the fire would quite likely overcome the residents even though the fire has not entered the heat stage.

The smoke stage of the fire is, of course, particularly dangerous during nighttime hours when the inhabitants of the house are asleep. In order to provide an earlier warning of fires, smoke detectors, designed to provide an alarm during the early smoke stage of the fire, were developed. The two basic types of smoke detectors presently in use are the ionization type and the photoelectric type.

The ionization smoke detector normally involves a chamber having a first electrode, a second electrode and a radiation source positioned therebetween. The radiation source ionizes the air between the first and second electrodes to create an electric current between them which is detected by a detector circuit to maintain an alarm in an off condition. Should smoke enter the area between the first and second electrodes, called the sensing chamber, the smoke molecules which are larger than the ionized air molecules impede the progress of the ionized air molecules from one electrode to the other thus decreasing the current flow between these two electrodes. The detector detects the decreased current flow to sound the alarm. A second chamber, also having two electrodes and an ionization source therebetween, is sometimes provided in a sealed chamber so that it is responsive to changes in atmospheric pressure and humidity but not smoke. This second chamber, i.e. the reference chamber, compensates the detector for changes in humidity at atmospheric pressure.

The photoelectric type of detector has been developed in two configurations. The first is the light obscuration configuration in which a light source is mounted directly opposite a photocell such that, when no smoke is present, the light from the source impinges upon the photocell which is thereby made conductive. When smoke enters the sensing chamber, the light flowing from the source to the cell is obscured and the current flow through the photocell is reduced which is detected to provide an alarm. The second configuration is the light scattering type in which the light source and the photocell are mounted at right angles with respect to one another. With no smoke in the chamber, no light from the light source impinges upon the photocell and, therefore, the current flow through the photocell is small. As light enters the sensing chamber, lights reflects off of or is scattered by the smoke molecules and is detected by the photocell which results in an increased current. This increased current is detected to provide the appropriate alarm.

SUMMARY OF THE INVENTION

Although the prior art smoke detectors operate satisfactorily to provide an early warning of fires, the present invention relates to a simpler and more economical type of smoke detector. The present smoke detector comprises first and second conductors, which may be grids, in non-electrical contact, having between them a smoke responsive coating which, in the presence of smoke, reacts to allow conduction between the first and second conductors. In the alternative, the coating itself may be conductive and, in the presence of smoke, it may lose its conductivity. A heating and cooling mechanism may be provided to condense the byproducts of combustion on the sensor to thereby concentrate these byproducts during the heating cycle and to evaporate any condensed water and to aid the reaction during the heating cycle. An additional two conductors or grids, without the chemical coating which is reactive to byproducts of combustion, may be provided to compensate for changes in humidity or atmospheric pressure.

BRIEF DESCRIPTION OF THE DRAWINGS

These and other features and advantages will become apparent from a detailed review of the invention taken in conjunction with the drawings in which.

DETAILED DESCRIPTION OF THE INVENTION

Figure 1:
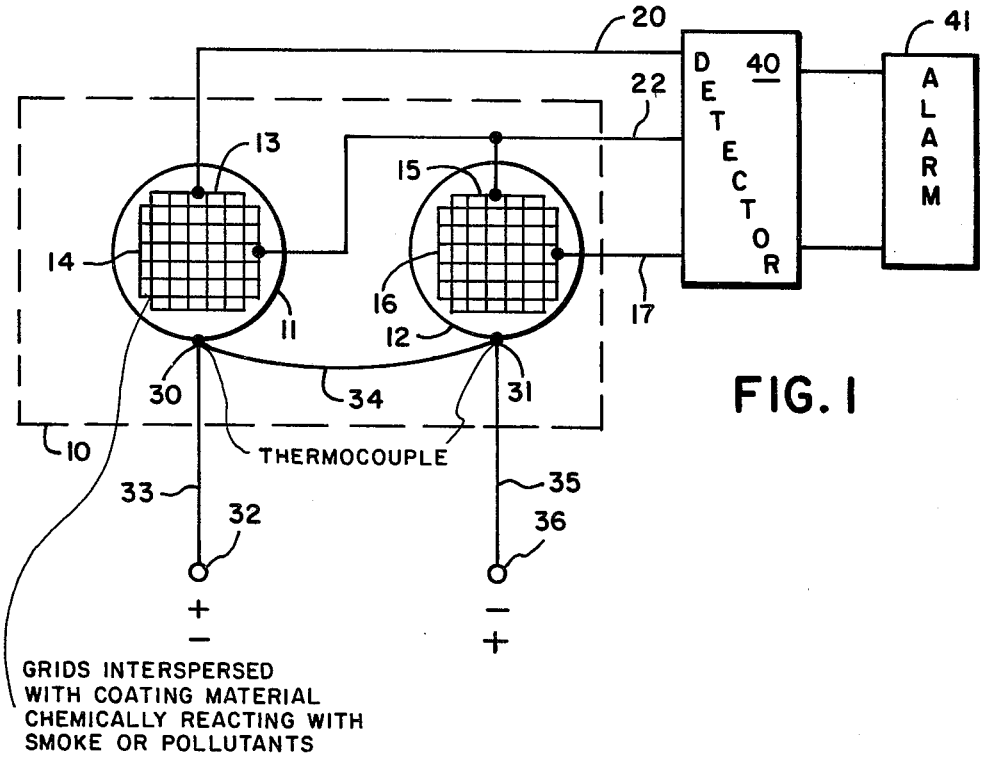
FIG. 1 shows the sensor arrangement in a detection system.
Figure 2:
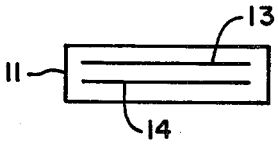
FIG. 2 is a sideview of one of the sensing grid arrangements shown in FIG. 1; and, FIG. 3 presents an alternative conductor arrangement for a sensor.

In FIG. 1, sensor 10 is comprised of a first grid arrangement 11 and a second grid arrangement 12. Second grid arrangement 12 may be eliminated although its inclusion is desirable to compensate for changes in humidity and atmospheric pressure. Grid arrangement 11 has a first conductor or grid 13 in close proximity to a second conductor or grid 14 but are in non-electrical contact with one another. A sideview of this arrangement is shown in FIG. 2 where the grid 13 is positioned above the grid 14. The second arrangement 12 has a first conductor or grid 15 in close proximity to a second conductor or grid 16 but are in nonelectrical contact. The junctions 30 and 31 of a thermocouple or thermopile are in intimate heat transfer contact with the grid arrangements 11 and 12, respectively, to act as a heating and cooling mechanism for the grids. Junction 30 is connected to terminal 32 by line 33 and is connected to junction 31 by line 34. Junction 31 is connected by line 35 to terminal 36. A changing polarity current source is supplied to terminals 32 and 36 for applying a reversible voltage to the junctions 30 and 31. Thus, each junction will either be in a heating mode or in a forced or ambient cooling mode depending upon the instantaneous polarity of the signal supplied by the source connected to terminals 32 and 36. Junction 30 will, therefore, successively heat and cool the grid arrangement 11 as the polarity of the source connected to terminals 32 and 36 changes. Likewise, junction 31 will be operated through successive cooling and heating stages as the polarity of the signal from the source connected to terminals 32 and 36 changes.

Conductor 20 connects grid 13 to detector 40, conductor 22 connects grids 14 and 15 to detector 40 and conductor 17 connects grid 16 to detector 40. The output at detector 40 is connected to an alarm 41. The detector may take the form of the detecting circuit shown in U.S. Pat. No. 3,812,362 for sensing the current flow through the sensor and detecting the level of the current flow to sound an alarm when smoke is present.

The grid arrangement 11 is coated with a film former impregnated with a chemical selected to react with the byproducts of combustion occasioned by a fire. One such chemical may be a patina having the chemical formula $Cu_2(OH)_2CO_3$ for ammonia detection. The patina will react with the ammonia to produce complex copper ammoniate ions, $Cu(NH_3)_4{}^{+4}$, in addition to water and carbon dioxide. In this arrangement, the coating material is initially non-conductive so that the current supplied by the grid arrangement 11 to the detector 40 is very small. In the presence of ammonia, the coating material becomes conductive increasing the current flow through the detector which responds by energizing the alarm. As the changing polarity current source connected to terminals 32 and 36 supplies alternating voltage to the junctions 30 and 31, the grid arrangement 11 is alternately cooled and heated. During cooling, the ammonia in the air condenses on the grids 13 and 14 and is thereby concentrated to react with the patina. During the heating cycle, the water which is formed by the reaction between the ammonia and the patina is evaporated and, of course, the carbon dioxide escapes. In this case, the grids 13, 14, 15 and 16 can be copper grids.

In the alternative, the grids may be made from an aluminum alloy and the coating material may consist of a film impregnated with silver oxide $Ag_2O$. Silver oxide reacts with ammonia to produce silver ammonia ions, $Ag(NH_3)_2{}^+$ and hydroxide ions, $OH^-$. In this arrangement, the thermocouple junction 30, during its cooling mode, condenses the ammonia onto the grid arrangement 11 during which the silver oxide begins to react with the ammonia. This grid is normally nonconductive, but, after reaction and in the presence of the ions, conduction begins to occur which increases the current level to the detector 40.

In another arrangement, the grids 13–16 may be lead plated and the coating material may be a film impregnated with lead acetate, $Pb(CH_2COO)_2$. In this arrangement, as the thermocouple junction 30 alternately heats and cools the grid arrangement 11, the current supply to the detector 40 will vary since the conductivity of lead acetate is dependent upon temperature. However, in the presence of hydrogen sulphide, $H_2S$, the lead acetate will react with hydrogen sulphide to form lead sulphide, PbS, and acetic acid, $CH_2COOH$. The conductivity of acetic acid is not dependent upon temperature so that the grid arrangement 11 goes from a varying conductivity state just prior to reaction to a steady conductive state after reaction. The detector can then sense this change to energize the alarm 41.

In another form, the grids 13–16 may be made of an aluminum alloy and the coating material may be a film impregnated with iodine pentoxide, $I_2O_5$. Iodine pentoxide has a low conductivity but, in the presence of carbon monoxide, another byproduct of combustion, a reaction will take place forming carbon dioxide and iodine, $I_2$. The iodine will react with the aluminum of the aluminum alloy grid to form aluminum iodide, $AlI_3$. Aluminum iodide is more highly conductive which can be then detected by the detector 40 to energize alarm 41.

Another configuration to detect carbon monoxide uses a carbon grid for the grids 13–16 and uses paladium chloride, $PdCl_2$, as the coating material.

Finally, hydrogen cyanide, HCN, can be another byproduct of combustion. One arrangement to sense hydrogen cyanide is an arrangement where the grids 13–16 are nickel plated and where the film material is impregnated with nickel perchlorate, $Ni(ClO_4)_2 \cdot 6H_2O$. Nickel perchlorate, which is conductive, reacts with hydrogen cyanide to form nickel cyanide, $Ni(CN)_2$, perchloric acid, $HClO_4$, and water. The perchloric acid decomposes and the water evaporates to leave the nickel cyanide. Nickel cyanide results in a decrease in the current flow to the detector.

Figure 3:
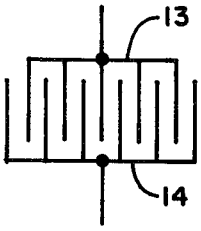

FIG. 3 shows an alternative grid arrangement where grids 13 and 14 are substantially coplanar.

The embodiments of the invention in which an exclusive property or right is claimed are defined as follows:

1. A system for providing an alarm function in the presence of smoke or pollutants comprising:

a sensor having first and second conductors in non-electrical contact, a coating material interspersed between and among said first and second conductors, said coating material chemically reacting with by-products of combustion or pollutants to affect conductivity between said first and second conductors;

power supply means for supplying power to said first and said second conductors;

detector means connected to said first and second conductors for providing an output signal upon the presence of smoke; and, alarm means responsive to said output signal for providing an alarm indication.

2. The system of claim 1 further comprising compensation means having third and fourth conductors, in non-electrical contact, connected between said power supply means and said detector means to compensate for changes in humidity and atmospheric pressure.

3. The system of claim 2 further comprising heating and cooling means in thermal contact with said first, second, third and fourth conductors for heating and cooling said sensor to condense said byproducts of combustion or pollutants onto said sensor during cooling and to evaporate, during heating, any water condensed on the sensor.

4. The system of claim 1 further comprising heating and cooling means in thermal contact with said first and second conductors for heating and cooling said sensor to condense said byproducts of combustion or pollutants onto said sensor during cooling and to evaporate, during heating, any water condensed on the sensor.

5. A sensor for chemically sensing smoke or pollutants comprising:

first and second conductors in non-electrical contact, said first and second conductors adapted to be connected to a source of power; and, a coating material interspersed between and among said first and second conductors, said coating material chemically reacting with byproducts of combustion to affect conductivity between said first and second conductors.

6. The sensor of claim 5 further comprising heating and cooling means for alternately heating and cooling said sensor, said byproducts of combustion condensing on said sensor during cooling and condensed water being evaporated during heating.

7. The sensor of claim 6 further comprising detector means connected to said first and second conductors for sensing the conductivity between said first and second conductors.

8. The sensor of claim 6 wherein said heating and cooling means comprises a thermocouple in heat transfer contact with said sensor.

9. The sensor of claim 8 further comprising compensation means having third and fourth conductors in non-electrical contact, said third conductor connected to said first conductor and said fourth conductor connected to said second conductor, said third and fourth conductors adapted to be connected to a source of power, to compensate for changes in humidity and atmospheric pressure.

10. The sensor of claim 9 further comprising heating and cooling means for alternately heating and cooling said third and fourth conductors.

11. The sensor of claim 10 wherein said heating and cooling means for said third and fourth conductors comprises thermocouple means.

12. The sensor of claim 11 further comprising detector means connected to said first, second, third and fourth conductors for responding to changes of conductivity between said first and second conductors and between said third and fourth conductors.

13. The system of claim 12 wherein said first, second, third and fourth conductors are grids.

14. The sensor of claim 5 further comprising compensation means having third and fourth conductors in non-electrical contact, said third conductor connected to said first conductor and said fourth conductor connected to said second conductor, said third and fourth conductors adapted to be connected to a source of power to compensate for changes in humidity and atmosphere pressure.

15. The sensor of claim 14 wherein said first, second, third and fourth conductors are grids.

16. The sensor of claim 14 further comprising heating and cooling means in thermal contact with said first, second, third and fourth conductors for heating and cooling said sensor to condense, during cooling, said byproducts of combustion onto said sensor and to evaporate, during heating, water condensed on the sensor.

17. The sensor of claim 16 wherein said first, second, third and fourth conductors are grids.

18. The sensor of claim 17 further comprising detector means connected to said first, second, third and fourth conductors to detect changes in conductivity between said first and second conductors and between said third and fourth conductors.

19. The sensor of claim 16 further comprising detector means connected to said first, second, third and fourth conductors for responding to any changes in conductivity between said first and second conductors and between said third and fourth conductors in response to smoke or pollutant.

20. The sensor of claim 14 further comprising detector means connected to said first, second, third and fourth conductors responsive to any changes in conductivity between said first and second conductors and between said third and fourth conductors in response to smoke or pollutant.

21. The sensor of claim 20 wherein said first, second, third and fourth conductors are grids.

22. The sensor of claim 5 wherein said first and second conductors are grids.

23. The sensor of claim 5 further comprising detector means connected to said first and second conductors for responding to any changes in conductivity therebetween.

* * * * *